US006799761B2

(12) United States Patent
Kato

(10) Patent No.: US 6,799,761 B2
(45) Date of Patent: Oct. 5, 2004

(54) SHEET-POSITION DETECTION DEVICE AND IMAGE FORMING APPARATUS INCLUDING THE SAME

(75) Inventor: Takayuki Kato, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 09/803,973

(22) Filed: Mar. 13, 2001

(65) Prior Publication Data

US 2001/0024012 A1 Sep. 27, 2001

(30) Foreign Application Priority Data

Mar. 15, 2000 (JP) ..... 2000-072957
Jun. 21, 2000 (JP) ..... 2000-186938

(51) Int. Cl.[7] ..... B65H 9/04
(52) U.S. Cl. ..... 271/242; 399/86
(58) Field of Search ..... 399/389, 394, 399/395, 396, 401, 86

(56) References Cited

U.S. PATENT DOCUMENTS 4,538,905 A * 9/1985 Griego et al. ..... 347/139
4,639,121 A * 1/1987 Looney ..... 399/202
4,743,945 A * 5/1988 Ito et al. ..... 355/145 H
4,755,855 A 7/1988 Watanabe ..... 355/14 SH
4,908,673 A * 3/1990 Muramatsu ..... 355/311
5,086,319 A * 2/1992 Carolan ..... 355/317
5,523,833 A 6/1996 Tomari et al. ..... 355/309
5,557,391 A * 9/1996 Kato et al. ..... 355/319
5,708,954 A * 1/1998 Ando et al. ..... 399/402
5,857,137 A * 1/1999 Sakata et al. ..... 399/402
6,027,108 A * 2/2000 Johdai et al. ..... 271/3.02
6,052,552 A * 4/2000 Ohsumi et al. ..... 399/394
6,067,439 A 5/2000 Kadokura et al. ..... 399/388
6,151,458 A * 11/2000 Sato et al. ..... 399/16
6,421,139 B1 * 7/2002 Takami et al. ..... 358/1.2
6,429,945 B1 * 8/2002 Loffler ..... 358/1.12

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

A sheet-position detection device has a stop unit for temporarily stopping a sheet conveyed along a sheet conveying path, and a sheet-position detector for detecting a position of the sheet in a direction transverse to a conveying direction of the sheet during the stop of the sheet. The stop unit includes a pair of rotating members for rotating in order to convey the sheet while grasping the sheet, and a sheet-position detector detects an edge of the sheet parallel to the sheet conveying direction.

14 Claims, 6 Drawing Sheets

SHEET-POSITION DETECTION DEVICE AND IMAGE FORMING APPARATUS INCLUDING THE SAME

BACKGROUND OF THE INVENTION

1. Field of the Invention

The present invention relates to a sheet-position detection device for detecting the position of a conveyed sheet, and an image forming apparatus, such as a copier, a facsimile apparatus, a printer, a composite apparatus having the functions of these apparatuses, or the like, which includes the sheet-position detection device in the main body thereof, for forming an image on a sheet.

2. Description of the Related Art

Some conventional image forming apparatuses are configured such that, in order to form an image at an appropriate position, for example, at a central position, in a direction crossing a sheet conveying direction, the image forming position can be moved in a direction crossing the sheet conveying direction. In such an image forming apparatus, the position of a conveyed sheet in a direction crossing a sheet conveying direction is detected by a sheet-position detection device mounted in the main body of the image forming apparatus before the image formation location, and the image forming position is adjusted and moved in a direction crossing the sheet conveying direction based on position information.

Particularly, in recent image forming apparatuses, in order to improve productivity during duplex image formation, a sheet is re-conveyed to an image forming portion for image formation on a second surface after image formation on a first surface without performing regulation in a direction crossing a sheet conveying direction, such as lateral alignment in a stack-type intermediate tray. Hence, the position of the sheet in a direction crossing the sheet conveying direction varies due to various factors, and it is sometimes impossible to accurately form an image at the appropriate position.

Accordingly, in order to transfer an image at the appropriate position on the second surface of the sheet, a technique to detect the position of an edge of the sheet in a reconveyance path is indispensable.

In order to solve the above-described problem, recent sheet-position detection devices are mostly provided at an upstream position near an image forming portion in order to detect a sheet which has been conveyed from a sheet feeding tray and on a first surface of which an image is not yet formed, as well as in image formation on a second surface, and improve accuracy in position in image formation. Furthermore, detection of an edge of a sheet is performed for a sheet being conveyed (moving), so as not to degrade efficiency in sheet conveyance.

Sheet-position detection devices are grossly classified into two types of devices, i.e., contact-type devices, each including a detection flag contacting an edge of a sheet, and means for detecting the operation of the detection flag when contacting the sheet, and a non-contact-type devices for detecting an edge of a sheet using a light-transmitting-type sensor instead of directly contacting the edge.

Sheets include ordinary paper, thin resin sheets serving as a substitute for ordinary paper, thick paper, postcards, labels and the like.

Recent image forming apparatuses have higher conveying speeds as a result of pursuit of higher productivity. The pursuit of higher productivity is required for all sheet sizes. At the same time, requests for an improvement in the stability and accuracy of the image forming position on a sheet are increasing.

However, the above-described conventional sheet-position detection devices sometimes cannot respond to the recent request for a higher speed. That is, a sheet being conveyed at a high speed vibrates considerably. Hence, particularly in a sheet-position detection device using a contact-type detection flag which directly touches an edge of the sheet, the detection flag is pushed by the sheet more than necessary, thereby sometimes causing a degradation of accuracy in detection, even causing erroneous detection. In addition, the amount of wear of a portion of the detection flag contacting an edge of a sheet conveyed at a high speed increases as the conveying speed increases. Accordingly, contact-type sheet-position detection devices cannot respond to a recent request for high durability, for example, because of extreme degradation in detection accuracy by a detection flag after the lapse of limit period of durability, and damage of the detection flag after wear proceeds.

Furthermore, when detecting a sheet which is short in the conveying direction during high-speed conveyance, the time for detection becomes shorter, resulting in further difficulty in detection. In order to solve such a problem, it is necessary to increase the speed of the operation and the control of a detection mechanism, irrespective of use of a contact type or a non-contact type, resulting in a increase in the cost of the sheet-position detection device.

SUMMARY OF THE INVENTION

The present invention has been made in consideration of the above-described problems.

It is an object of the present invention to provide a sheet-position detection device in which accuracy in sheet-position detection is improved while achieving high productivity, high durability, and reduction in the production cost, and an image forming apparatus in which an image is formed on a predetermined position of a sheet according to sheet-position information of the sheet-position detection device.

According to one aspect, the present invention which achieves the above-described object relates to a sheet-position detection device including means for temporarily stopping a sheet conveyed along a sheet conveying path, and sheet-position detection means for detecting a position of the sheet in a direction crossing a conveying direction of the sheet during the stoppage of the sheet.

In one embodiment, the stop means includes a pair of rotating members for rotating in order to convey the sheet while grasping the sheet.

In another embodiment, the sheet-position detection means detects an edge of the sheet parallel to the sheet conveying direction.

In still another embodiment, the sheet-position detection means includes a detection flag rotatable by contacting the edge of the sheet parallel to the sheet conveying direction, and a sensor for detecting rotation of the detection flag.

In yet another embodiment, the detection flag is provided at a moving member movable in the direction crossing the sheet conveying direction, and the position of the sheet is calculated based on a distance of the moving member moved until the detection flag covers the sensor.

According to another aspect, the present invention which achieves the above-described object relates to an image forming apparatus including a sheet mounting unit for mounting sheets, image forming means for forming an image on a sheet supplied from the sheet mounting unit so as to be adjustable in a direction crossing a direction of conveying the sheet, the above-described sheet-position detection device, and image-formation control means for determining a position of formation of the image based on sheet-position information from the sheet-position detection device.

According to still another aspect, the present invention which achieves the above-described object relates to an image forming apparatus including a sheet mounting unit for mounting sheets, image forming means for forming an image on a sheet supplied from the sheet mounting unit so as to be adjustable in a direction crossing a direction of conveying the sheet, skew correction means, positioned between the sheet mounting unit and the image forming means, for correcting skew of the sheet supplied from the sheet mounting means by temporarily receiving the sheet, the above-described sheet-position detection device, and image-formation control means for determining a position of formation of the image based on sheet-position information from the sheet-position detection device. The skew correction means also operates as the stop means of the sheet-position detection device.

According to yet another aspect, the present invention which achieves the above-described object relates to an image forming apparatus including a sheet mounting unit for mounting sheets, image forming means for forming an image on a sheet supplied from the sheet mounting unit so as to be adjustable in a direction crossing a direction of conveying the sheet, a reversal guiding channel for guiding the sheet by turning the sheet so as to form an image on a surface opposite to a surface where the image has been formed by the image forming means, skew correction means, provided in the reversal guiding channel, for correcting skew of the sheet subjected to reversal guiding by temporarily stopping the sheet, the above-described sheet-position detection device, and image-formation control means for determining a position of formation of the image based on sheet-position information from the sheet-position detection device. The skew correction means also operates as the stop means of the sheet-position detection device, and the sheet-position detection means of the sheet-position detection device is provided at the skew correction means.

In the sheet-position detection device of the present invention, since the detection of the position of the sheet in the direction crossing the conveying direction is performed while the sheet temporarily stops, it is possible to improve accuracy in sheet-position detection while achieving high productivity, high durability, and reduction in the production cost.

Since the image forming apparatus of the present invention includes the sheet-position detection device having high accuracy in sheet-position detection in the main body of the apparatus, it is possible to accurately and assuredly form an image at a predetermined position of a sheet.

According to the present invention, by bending the reversal path provided in the conveying unit so as to be separated from the sheet mounting unit, and causing the conveying path to join with the reversal path at the bent portion, it is possible to perform stable sheet conveyance while achieving reduction in the size of the image forming apparatus.

DESCRIPTION OF THE PREFERRED EMBODIMENT

A preferred embodiment of the present invention will now be described in detail with reference to the drawings. The material, the shape, the relative arrangement of each of components described in this embodiment are not intended to limit the scope of the present invention, unless specifically described.

Figure 1:
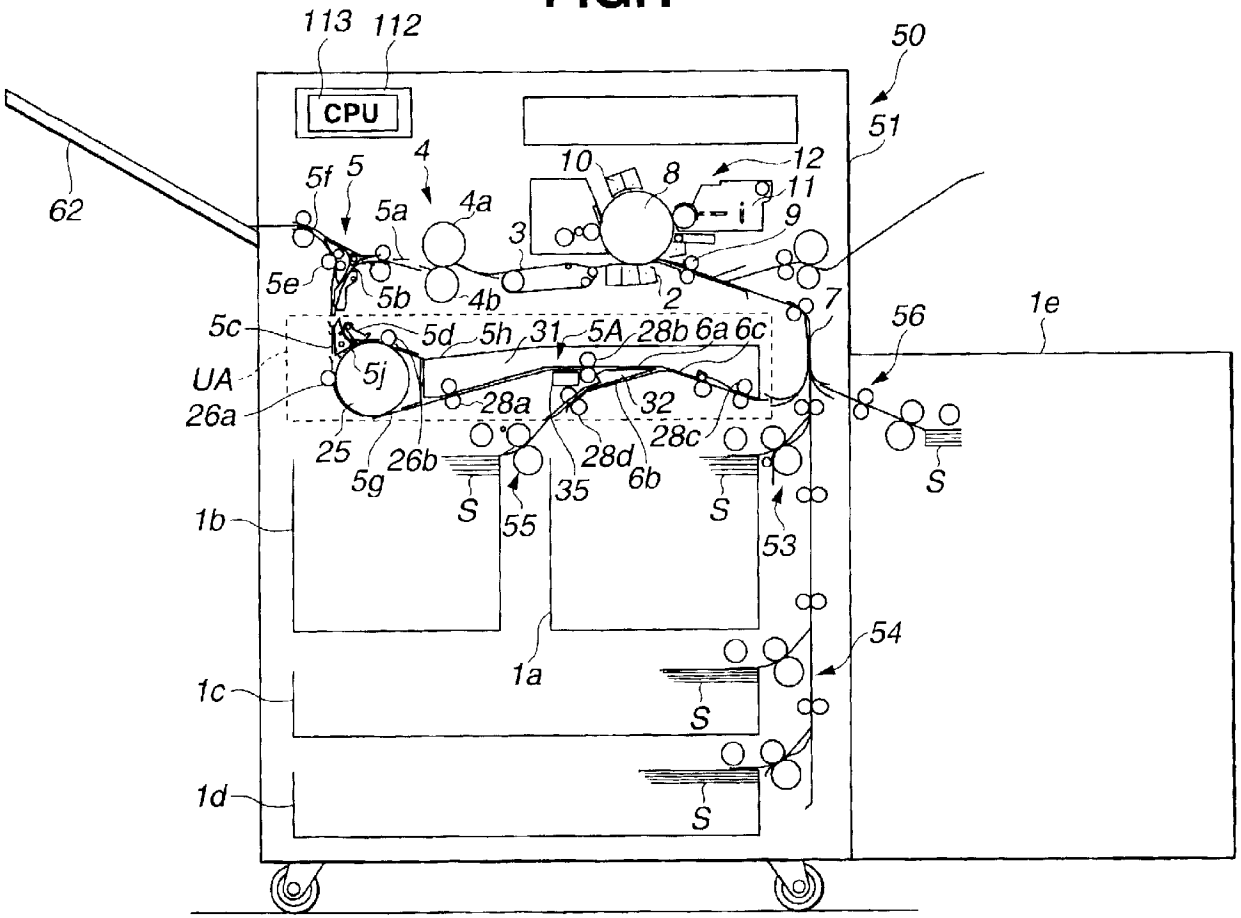
FIG. 1 is a diagram illustrating the configuration of an image forming apparatus according to an embodiment of the present invention.

FIG. 1 is a diagram illustrating the configuration of an image forming apparatus according to this embodiment.

In FIG. 1, there are shown an image forming apparatus 50, a main body 51 of the image forming apparatus 50 (hereinafter termed an "apparatus main body"), sheet feeding trays (trays 1*a*, 1*b*, 1*c* and 1*d*), serving as a sheet accommodating unit, and a sheet feeding deck 1*e*. Reference numeral 12 represents an image forming unit. One of sheets S accommodated in the sheet feeding tray 1 or the sheet feeding deck 1*e* is conveyed to the image forming unit 12 after being passed through a conveying path 7 by respective pairs of sheet feeding rollers 53–56, and a toner image formed in the image forming portion 12 is transferred onto the conveyed sheet S by transfer means 2.

After the transfer of the toner image, the sheet S is conveyed to fixing means 4 by a conveying belt 3, and the toner image is fixed by being heated and pressed by a heat roller 4*a* and a pressure roller 4*b* constituting the fixing means 4.

After the image transfer, in the case of single sided copying, the sheet S is discharged onto a discharged-sheet tray 62 after passing through conveying paths 5*a* and 5*f* constituting a sheet discharging channel provided in a discharged-sheet reversal unit 5.

In the case of duplex copying (image formation on both surfaces of the sheet S), the sheet S enters a conveying path 5*h*, serving as a reversal portion for reversing (turning) the sheet S, after passing through conveying paths 5*a*, 5*b* and 5*d*, and is again conveyed to the image forming unit 12 in a reversed state along a reversal channel 5A including conveying paths 5*j*, 5*g*, 6*a* and 6*c*. A toner image is transferred onto the sheet S conveyed to the image forming unit 12 in the above-described manner. Then, the sheet S passes through the conveying belt 3 and the fixing means 4, and is then subjected to straight discharge after passing through the conveying paths 5*a* and 5*f*.

In FIG. 1, symbol UA represents a duplex reversal unit, serving as a conveying unit drawably mounted in the apparatus main body 51. The duplex reversal unit UA includes a conveying path 5*c*, a curved conveying path 5*j* connecting the conveying paths 5*h* and 5*g*, the reversal channel 5A, and a large-diameter roller 25, capable of rotating in a forward or reverse direction, whose outer circumferential surface has a curvature substantially the same as the curvature of the conveying paths 6*b* and 5*j* (to be described later) joining with the reversal path 5A, i.e., equals the inner diameter surface of the curved conveying path. The large-diameter roller 25 includes two driven rollers 26*a* and 26*b* rotating integrally with the large-diameter roller 25.

Figure 2:
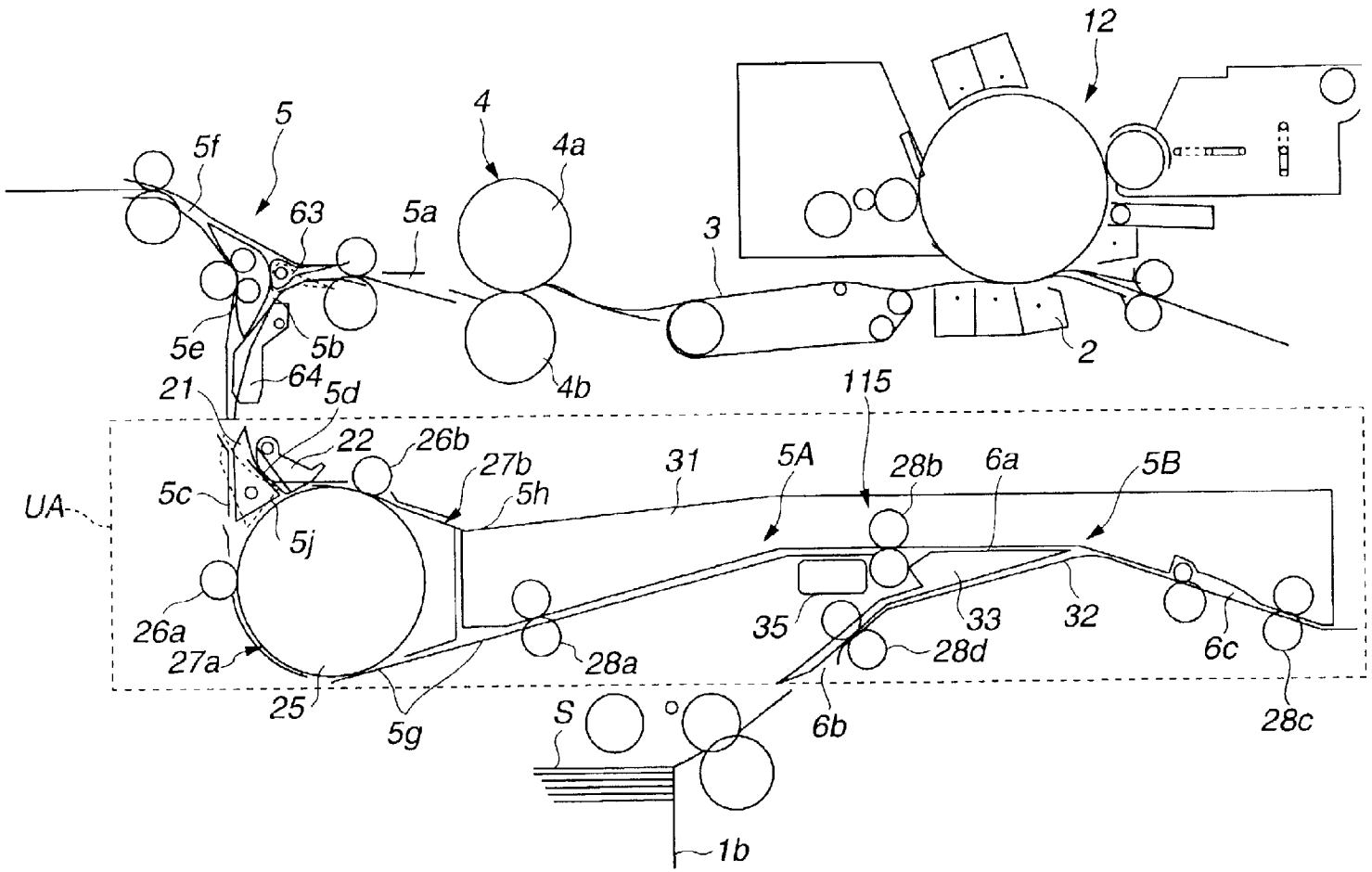
FIG. 2 is a diagram illustrating a sheet conveying path after fixing means of the image forming apparatus.

FIG. 2 is a diagram illustrating a sheet conveying path downstream of fixing means 4. In FIG. 2, a discharged-sheet first flapper 63 performs path switching at straight sheet discharge, reversal sheet discharge and duplex copying, by means of driving means (not shown), such as a solenoid or the like.

A discharged-sheet second flapper 64 prevents the sheet S moving upward by the reversal rotation (clockwise rotation) of the large-diameter roller 25 during reversal sheet discharge (to be described later) from returning in the direction of the conveying path 5*b*, and guides the sheet S to the conveying paths 5*e* and 5*f*. The discharged-sheet second flapper 64 is urged to the left, for example, by a spring (not shown) or the flapper's own weight.

A duplex first flapper 21 operates as switching means for guiding the sheet S guided to the conveying path 5*b* by switching of the discharged-sheet first flapper 63 to the conveying path 5*c* or 5*d*. The switching of the duplex first flapper 21 is performed by means of driving means (not shown), such as a solenoid or the like.

A duplex second flapper 22 prevents, in duplex copying (to be described later), the sheet S guided to the conveying path 5*d* by the duplex first flapper 21, which has assumed a state shown by broken lines, from returning in the direction of the conveying path 5*d*, after entering the conveying path 5*h* and then moving to the left in FIG. 2 by the reverse rotation (counterclockwise rotation) of the large-diameter roller (to be described later), and guides the sheet S to the conveying path 5*j*. As the discharged-sheet second flapper 64, the duplex second flapper 22 is urged downward in FIG. 2, for example, by a spring (not shown) or the flapper's own weight.

Sheet detection means 27*a* is provided at a portion downstream from the driven roller 26*a*, and detects the sheet S drawn to the conveying path 5*g* by switching of the duplex first flapper 21 and the rotation of the large-diameter roller 25 in a counterclockwise direction, and the driven roller 26*a* during reversal sheet discharge.

Sheet detection means 27*b* is provided at a portion downstream from the driven roller 26*b*, and detects the sheet S drawn to the conveying path 5*h* by switching of the duplex first flapper 21 and the rotation of the large-diameter roller 25 in a clockwise direction, and the driven roller 26*b* during duplex copying.

Although not illustrated in detail in FIG. 2, the sheet detection means 27*a* and 27*b* may, for example, have a configuration where it protrudes into the conveying path, causing a flag having a center of rotation outside the conveying path to rotate when contacting the distal end of the sheet S, and detecting that a shield plate provided on the flag shields a light-emitting/sensing portion of a photo-interrupter.

When the sheet detection means 27*a* or 27*b* detects the leading edge of the sheet S, it outputs a detection signal to a CPU (central processing unit, not shown) provided in the apparatus main body 51. The CPU determines the timing of the stop or the reversal of the large-diameter roller 25 according to the detection signal from the sheet detection means 27*a* or 27*b* and information relating to the length of the sheet in the conveying direction input from an operation unit (not shown).

In this embodiment, the CPU stops the large-diameter roller 25, in reversal sheet discharge, at a position before the trailing edge of the sheet reaches the duplex reversal unit UA after passing through the discharged-sheet second flapper 64, and, in duplex copying, at a position before the trailing edge of the sheet reaches the driven roller 26*b* after passing through the duplex second flapper 22, and then reverses the sheet. In the case of a sheet which is long in the conveying direction, the CPU draws the sheet in the conveying direction by driving the conveying rollers 28*a* and 28*b* in synchronization with the large-diameter roller 25.

In FIG. 2, reference numeral 31 represents an openable guide, serving as a first guide member constituting the lower surface of the conveying path 5*h* and the upper surface of the conveying paths 6*a* and 6*c*. The openable guide 31 is made of a transparent resin or the like, and is rotatably supported on the duplex reversal unit UA.

Figure 3:
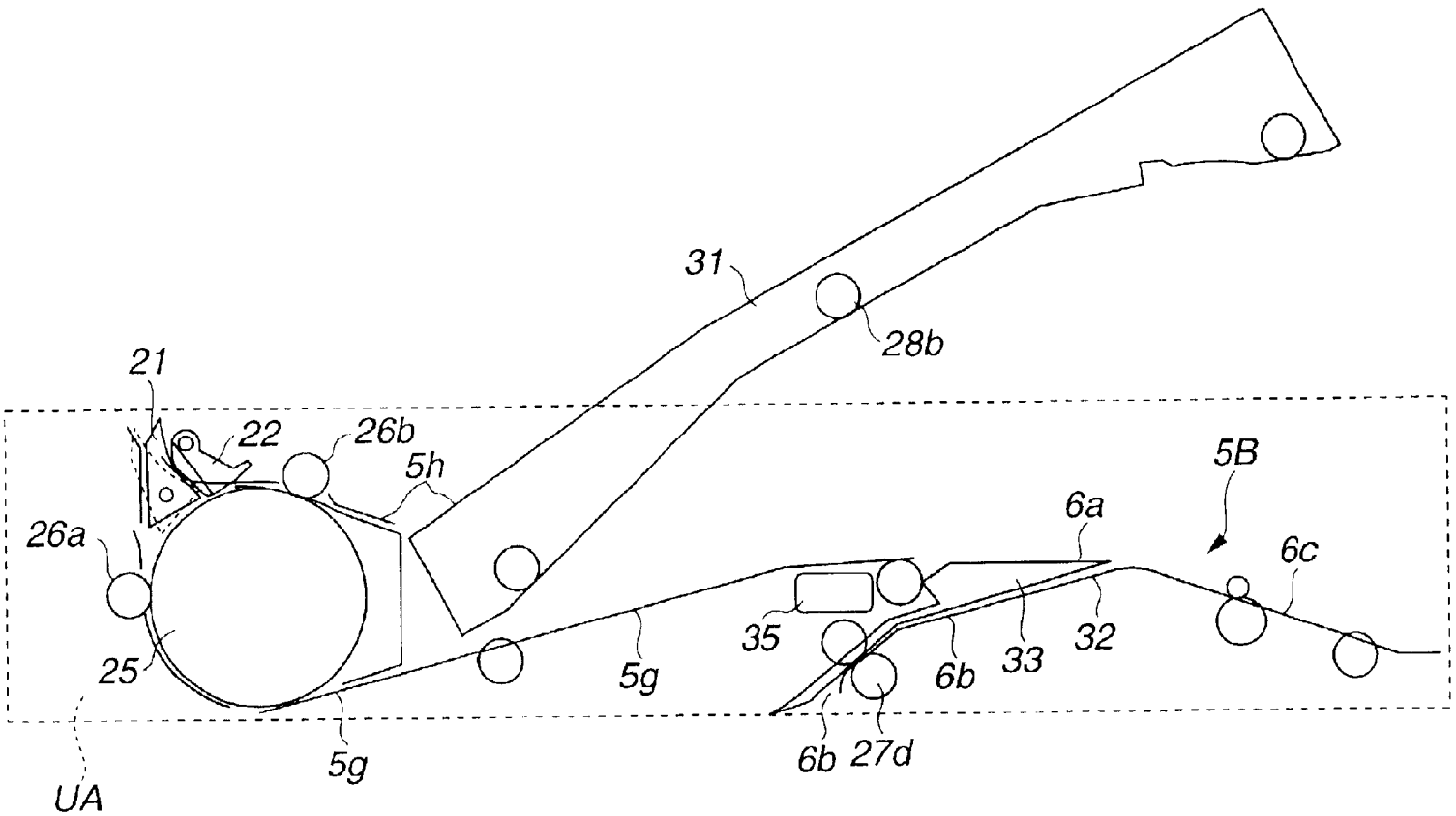
FIG. 3 is a diagram illustrating a state when removing a sheet jammed in a duplex reversal unit of the image forming apparatus.

By configuring the openable guide 31 in the above-described manner, it is possible to visually confirm a jammed sheet even if a jam occurs in the conveying path 5*g*, 6*a* or 6*c*, and assuredly process the jammed sheet. In jam processing, by rotating the openable guide 31 upward as shown in FIG. 3, the jammed sheet can be easily removed.

A lower guide plate 32 constitutes the lower surface of the conveying paths 6*b* and 6*c*, serving as a conveying channel for conveying each of the sheets S accommodated in the sheet feeding tray 1*b* An upper guide plate 33 serves as a second guide member constituting the upper surface of the conveying path 6*b* and the lower surface of the conveying path 6*a*, and is made of a transparent resin or the like. By thus forming the upper guide plate 33 of a transparent resin or the like, it is possible to visually confirm existence of a jammed sheet even if a jam occurs in the conveying path 6*b*, and assuredly process the jammed sheet.

Reference numeral 35 represents a sheet-edge detection mechanism, serving as detection means provided at a portion upstream from the pair of conveying rollers 28*b*. The sheet-edge detection mechanism 35 detects the position of the sheet reconveyed to the image forming unit 12 for duplex copying, in a direction perpendicular to the sheet conveying direction. Upon detection of the sheet, the sheet-edge detection mechanism 35 outputs position information to the CPU, which controls movement of the sheet to a predetermined position for image formation on the second surface, based on the information from the sheet-edge detection mechanism 35.

In this embodiment, the reversal channel 5A is bent so as to be separated from the sheet feeding tray 1*b*. By thus bending the reversal path 5A, the interval between the reversal channel SA and the sheet feeding tray 1*b* can be widened.

By providing the sheet-edge detection mechanism 35 between the reversal channel 5A and the sheet feeding tray 1*b* having an interval widened in the above-described manner, it is possible to provide the sheet-edge detection mechanism 35 below the conveying path 6*a* without increasing the height of the duplex reversal unit UA.

By thus widening the interval between the reversal channel 5A and the sheet feeding tray 1*b* and causing the conveying path 6*a* to join with a bent portion 5B of the reversal channel 5A, it is possible to cause the conveying path 6*b* to join with the conveying path 6*a* without increasing the height of the duplex reversal unit UA.

As a result, spaces above and below the duplex reversal unit UA only depend on the size of the curved conveying channel (the conveying path 5*j*) having a radius of curvature necessary for achieving stability of conveyance, and the overall size of the duplex reversal unit UA and the apparatus main body 51 can be reduced.

Next, the sheet conveying operation after the fixing means 4 of the image forming apparatus 50 configured in the above-described manner will be described in detail with reference to FIG. 2.

First, the case of straight sheet discharge will be described. In the case of straight sheet discharge, the sheet passing through the fixing means 4 is discharged after passing along the conveying paths 5*a* and 5*f* as directed by the discharged-sheet first flapper 63 switched to a position indicated by broken lines.

Next, the case of reversal sheet discharge will be described. In the case of reversal sheet discharge, the discharged-sheet first flapper 63 is switched to a position indicated by solid lines. Accordingly, the sheet enters the conveying path 5*b*, and moves toward the duplex reversal unit UA while pushing the discharged-sheet second flapper 64 to the right in FIG. 2. At that time, the duplex first flapper 21 is switched to a position indicated by solid lines. Accordingly, the sheet is guided to the conveying path 5*c* by the duplex first flapper 21, and is then drawn to the conveying path 5*g* by the large-diameter roller 25 rotating in a counterclockwise direction.

When the sheet detection means 27*a* detects the sheet moving in the above-described manner, the CPU stops the large-diameter roller 25 at a position before the trailing edge of the sheet reaches the duplex reversal unit UA after passing through the discharged-sheet second flapper 64 according to a detection signal from the sheet detection means 27*a* and information relating to the length of the sheet in the conveying direction, and then reverses the sheet.

The discharged-sheet second flapper 64 prevents the sheet, moving upward in FIG. 2 after the trailing edge of the sheet has passed, from returning toward the conveying path 5*b*, and returns to a position to guide the sheet to the conveying path 5*f*, for example, by the flapper's own weight. Thus, the sheet is discharged in a reversed state after passing along the conveying paths 5*a*, 5*c*, 5*e* and 5*f*.

Next, the case of duplex copying will be described. In the case of duplex copying, the sheet is guided to the conveying path 5*d* via the conveying path 5*b*, by the discharged-sheet first flapper 63 switched to the position indicated by the solid lines and the duplex first flapper 21 switched to the position indicated by the broken lines.

Thereafter, the sheet is drawn to the conveying path 5*h* while raising the duplex second flapper 22 upward, according to the rotation of the large-diameter roller 25 in a clockwise direction and the driven roller 26*b*. When the sheet detection means 27*b* provided at a portion downstream from the driven roller 26*b* has detected the sheet moving in the above-described manner, the CPU stops and reverses the rotation of the large-diameter roller 25 at a position before the trailing edge of the sheet reaches the driven roller 26*b* after passing through the duplex second flapper 22, according to a leading-edge detection signal from the sheet detection means 27*b* and information relating to the length of the sheet in the conveying direction.

After the trailing edge of the sheet has passed, the duplex second flapper 22 returns to a position to prevent the sheet moving to the left in FIG. 2 from returning toward the conveying path 5*d*, for example, by the flapper's own weight, and guide the sheet to the conveying path 5*j*. Accordingly, the sheet is guided to the conveying path 5*j*.

Then, the sheet is conveyed through the conveying channel (the conveying paths 5*j* and 5*g*) along the large-diameter roller 25, is conveyed to the conveying paths 6*a* and 6*c* by the respective pairs of conveying rollers 28*a*, 28*b* and 28*c*, again joins with the conveying channel 7 (FIG. 1), and is conveyed to the transfer means 2 in order to be subjected to image formation on the second surface.

As described above, the outer circumferential surface of the large-diameter roller 25 also serves as the inner wall surface of the curved conveying path 5*j*. Hence, the wall surface within the conveying channel moves at the same speed as the sheet conveying speed, relative to the sheet conveyed along the conveying path 5*j*.

In general, the conveyance resistance of a sheet conveyed along a curved portion (particularly, a portion where a direction is changed by at least 180 degrees) greatly depends on the frictional resistance of the inner wall surface, and the frictional resistance of the inner wall surface increases with the stiffness and thickness of the sheet. The curvature of the curved portion tends to be set to a small value in response to a recent request for a smaller apparatus.

Accordingly, by adopting the above-described configuration of moving the sheet along the wall surface (the large-diameter roller 25) within the conveying channel at the same speed as the conveying speed, it is possible to cause the frictional resistance of the inner wall surface to substantially disappear, and therefore provide a great effect for reducing the conveyance resistance for the sheet.

Furthermore, it is possible to maintain stability in conveyance even during high-speed conveyance for a very stiff sheet having, for example, a weighing of 200 g/m$^2$. By adopting the configuration of driving the single large-diameter roller 25 including the plurality of driven rollers 26*a* and 26*b*, the driving system is simpler and advantageous in the production cost and suppression of operational sound than in a configuration of sequentially conveying a sheet by driving a plurality of pairs of conveying rollers. In addition, since a guide member at the inner circumferential surface of the curved portion can be omitted, the production cost can be reduced.

As shown in FIG. 2, the upper surface of the conveying path 5*h* is substantially opened. Hence, when a jam occurs, by drawing the duplex reversal unit UA from the apparatus main body 51 to the front side, a jammed sheet in the conveying path 5*h* can be easily removed.

As described above, the openable guide 31 constituting the upper surface of the conveying path 5*h* and the lower surface of the reversal channel 5A (the conveying paths 5*g*, 6*a* and 6*c*) can be opened/closed and is made of a transparent material. Accordingly, when the duplex reversal unit UA is drawn, a sheet in the reversal channel 5A can be easily visually confirmed from above the duplex reversal unit UA.

Accordingly, the sheet can be confirmed by drawing the duplex reversal unit UA. If the openable guide 31 is opened after confirming the sheet, the jammed sheet can be assuredly processed.

In this embodiment, the upper guide plate 33 constituting the lower surface of the conveying path 6*a* and the upper surface of the conveying path 6*b* is also made of a transparent material. Hence, by opening the openable guide 31, a sheet remaining in the conveying path 6*b* can also be visually confirmed from above. By manually rotating the pair of conveying rollers 28*d* after visually confirming the sheet in the above-described manner, the jammed sheet can be easily processed.

By forming the upper guide 33 with a transparent material as described above, the inside of the conveying path 6*b* can be visually confirmed when the reversal channel 5A is opened by the openable guide 31. It is thereby possible to reduce the possibility of the user from forgetting to remove, and to reduce the burden on the user during jam processing.

Recently, it has been confirmed that curl of a sheet by heat is greatly influenced by the posture of conveyance of the sheet after being heated. Accordingly, as in this embodiment, if a sheet passes through a curved conveying channel or the like after being heated by the fixing means 4, curl of the sheet by heat is increased along the curvature.

Accordingly, in order to remove the heat given to the sheet as quickly as possible, for example, cooling air is sometimes blown against the sheet from below the conveying path 5*a*.

In this embodiment, as described above, in contrast to the conveying channel (the conveying paths 5*a*, 5*b*, 5*d* and 5*h*) during duplex copying, the conveying channel (the conveying path 5*a*, 5*b* and 5*c*) of a sheet during reversal sheet discharge is made to be linear after being bent by substantially 90 degrees from the conveying path 5*a* to the conveying path 5*b* after passing through the fixing means 4.

By thus forming the conveying channel during reversal sheet discharge, factors causing curl of the sheet by heat can be minimized. Particularly in the case of small-size sheets in which a large amount (about 1,000–3,000 sheets) of discharged sheets are often mounted, since a small amount of curl of each sheet by heat is accumulated to a large amount, the effect of a substantially linear conveying channel (the conveying paths 5*b* and 5*c*) in which a small-size sheet is substantially linearly accommodated is great.

Some of various types of sheets have different amounts of curl and even different directions of curl with the same heating and pressing conditions. In order to handle such sheets, there exists an approach in which during reversal sheet discharge, a sheet is conveyed along a curved conveying channel (the conveying paths 5*b* and 5*d*) while the temperature of the sheet is still high, and curl of the sheet by heat is corrected by a curve provided by the conveying paths 5*b* and 5*d*.

Correction curl of the sheet by heat by such a curved conveying channel (the conveying paths 5*b* and 5*d*) can be easily realized only by changing switching control of the duplex second flapper 22.

In such a configuration, the user, the serviceman or the like may arbitrarily change the conveying path by performing setting by operating input means (not shown). Alternatively, sheets to be used may be determined for respective sheet feeding trays 1*a*–1*d*, and the conveying path during reversal sheet discharge may be automatically selected (to be substantially linear or curved) in accordance with the selected sheet feeding tray. It is also effective to use sheet-thickness detection means, and automatically select the conveying path based on information relating to the thickness of a sheet from the sheet-thickness detection means.

A CPU 113 of a control device 112, serving as image-formation control means of the apparatus main body 51, controls the driving of the large-diameter roller 25 by determining the timing of speed control, stop or reversal rotation (rotation in a clockwise direction) of the large-diameter roller 25 according to a signal indicating arrival of the sheet S and information relating to the length of the sheet S in the conveying direction. The sheet drawing/conveying speed of the large-diameter roller 25 differs depending on the size of the sheet S in the conveying direction, in order to improve the productivity of the entirety of the copier (image forming apparatus) 50. The conveying speed is accelerated during conveyance of the sheet S for some sizes.

In the case of a sheet S which is long in the conveying direction, the respective pairs of conveying rollers 28*a* and 28*b*, serving as sheet conveying means, are driven in synchronization with the large-diameter roller 25, in order to deal with a drawn amount of the long sheet S. The pair of conveying rollers 28*b* operate as stop means, skew correction means and second skew correction means.

The CPU 113 within the apparatus main body 51 controls a motor (not shown) for rotating the large-diameter roller 25 by determining the timing of speed control, stop or reversal rotation (rotation in a counterclockwise direction) of the large-diameter roller 25, according to a signal indicating arrival of the sheet S and information relating to the size of the sheet S in the conveying direction. The sheet drawing/conveying speed by the driven roller 26*b* and the large-diameter roller 25 for causing the sheet S to reach the large-diameter roller 25 along the conveying path 5*h* differs depending on the size of the sheet S in the conveying direction, in order to improve the productivity of the entire apparatus. The sheet drawing/conveying speed by the driven roller 26*b* and the large-diameter roller 25*t* is accelerated during conveyance of the sheet S for some sizes of the sheet in the conveying direction.

Sheet-Position Detection Device

A sheet-position detection device 115 is disposed at the conveying path 6*a*. The sheet-position detection device 115 detects the position of the sheet S in a direction crossing the conveying direction of the sheet S reconveyed to the image forming unit for duplex image formation, and transmits position information to the CPU 113 of the control device 112, serving as the image-formation control means provided within the apparatus main body 51, in order to be able to adjust the position of image formation on the second surface of the sheet S. The sheet-position detection device 115 of this embodiment is a contact-type device which directly contacts an edge of the sheet S, and includes a sheet-end-position detection mechanism 35, serving as sheet-position detection means, a pair of conveying rollers 28*b*, and the like.

Figure 4:
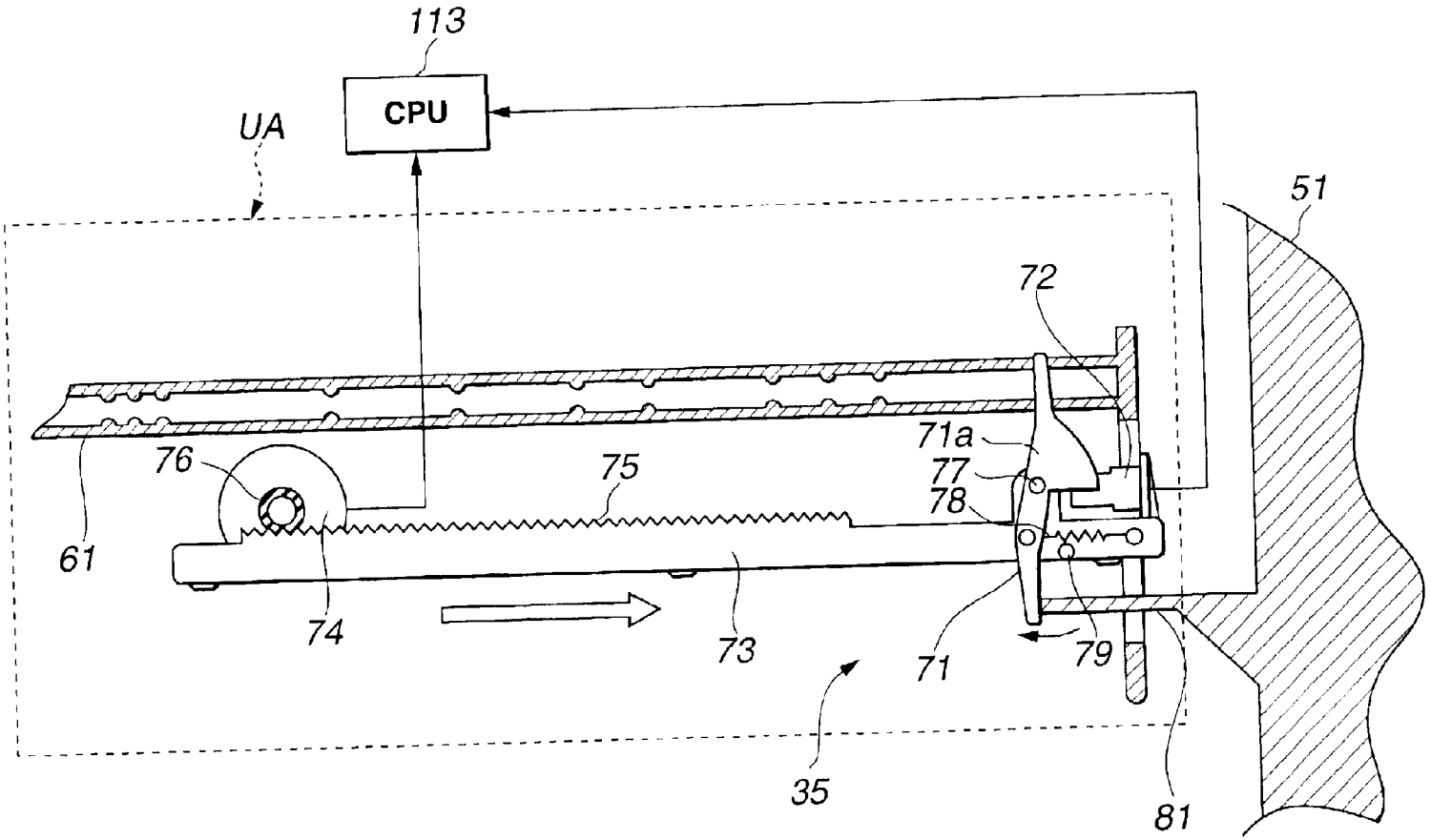
FIG. 4 is a diagram illustrating a sheet-position detection device shown in FIG. 2, as seen from the downstream side in a sheet conveying direction, and is also a cross-sectional view of the duplex reversal unit.
Figure 5:
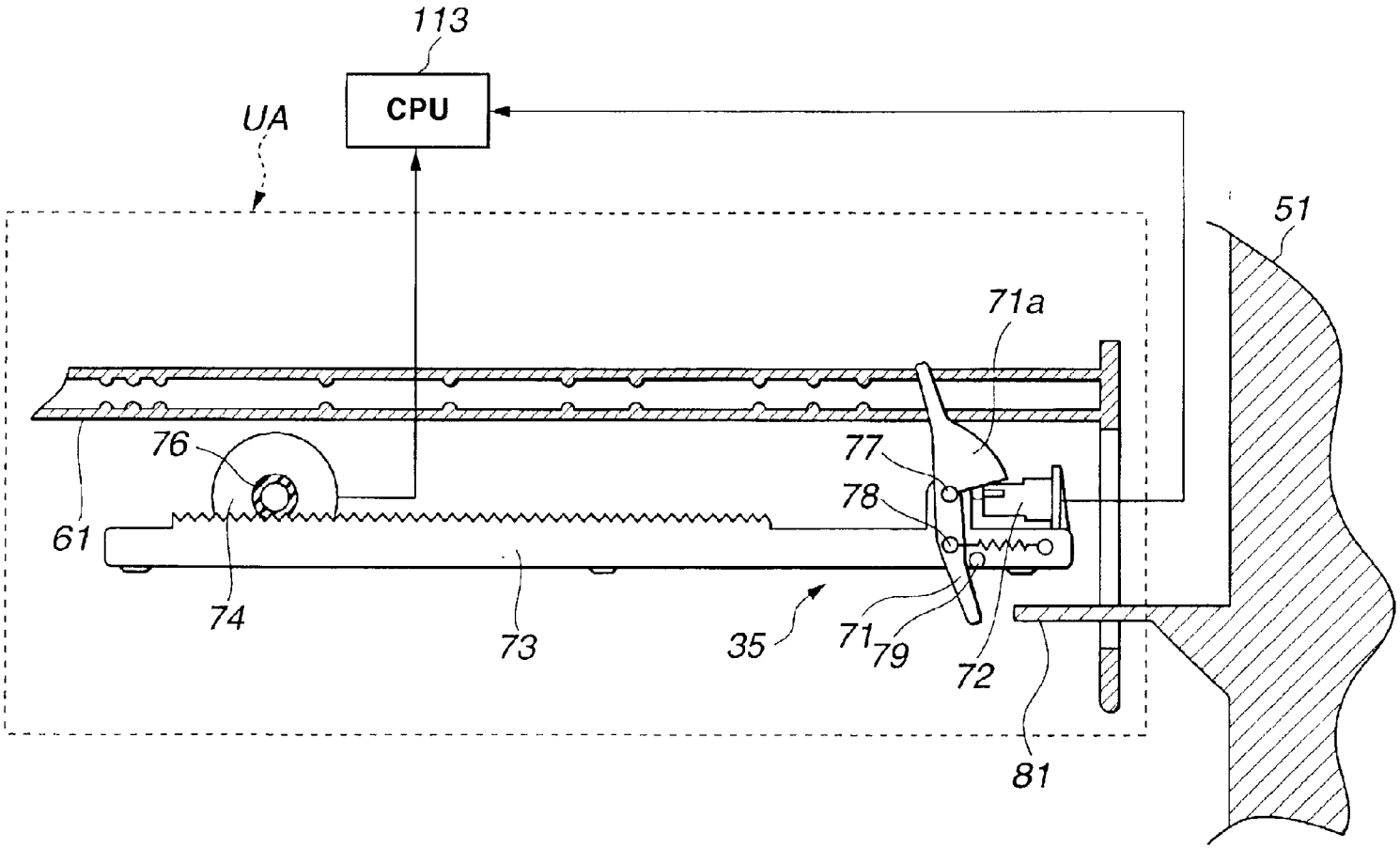
FIG. 5 is a diagram illustrating a state of awaiting detection of a sheet in the sheet-position detection device shown in FIG. 2.
Figure 6:
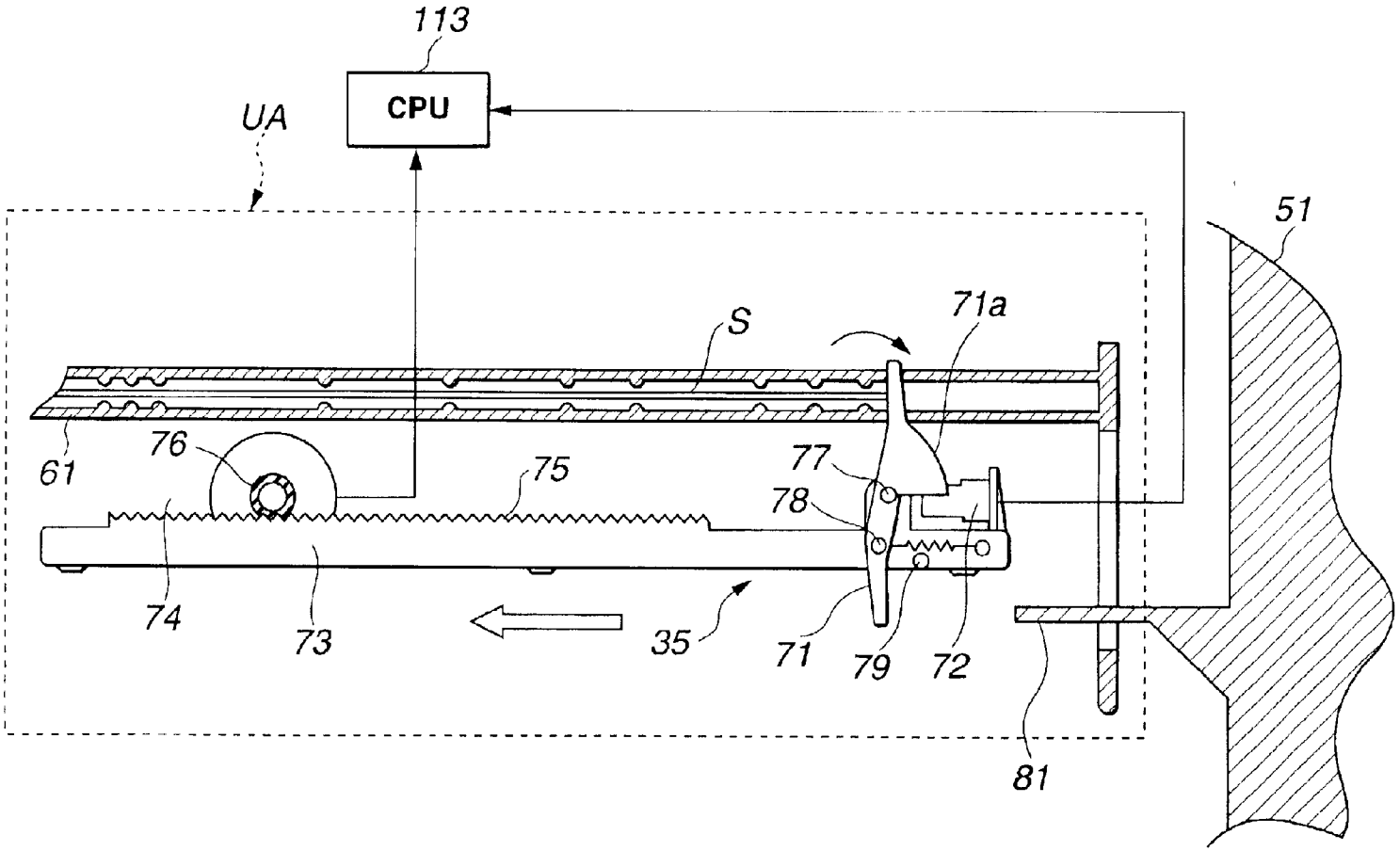
FIG. 6 is a diagram illustrating a state of detecting a sheet in the sheet-position detection device shown in FIG. 2.

FIGS. 4, 5 and 6 are detailed cross-sectional views illustrating the sheet-end-position detection mechanism 35 in which the duplex reversal unit UA is seen from the downstream side in the conveying direction. The sheet S is conveyed within a sheet guide unit 61 to the front side in FIGS. 4–6. A home detection plate 81, serving as a position reference for the sheet-end-position detection mechanism 35, is mounted on the apparatus main body 51.

The sheet-end-position detection mechanism 35 includes a flag 71 rotatably mounted on a supporting block 73, serving as a moving block, by a shaft 77, a photo-interrupter 72 to be shielded by a shield plate 71*a* which is fixed on the supporting block 73 in one body with the flag 71, an extension coil spring 78 stretched between the detection flag 71 and the supporting block 73 in order to urge the flag 71 in a direction opposite to the direction of rotation for detection, a stopper 79, provided so as to protrude from the supporting block 73, for stopping rotation of the detection flag 71, the supporting block 73 for supporting these components, a stepping motor 74 for moving the supporting block 73, the home detection plate 81, provided so as to protrude toward the inside of the apparatus main body 51, serving as a position reference for the detection flag 71 by receiving it.

The supporting block 73 has a rack 75 at a part thereof, so as to reciprocate in a direction crossing the sheet conveying direction by meshing of the rack 75 with a pinion 76 of the stepping motor 74.

FIG. 4 illustrates a state in which the flag 71 shields the photo-interrupter 72 by being rotated because the supporting block 73 has moved in a direction indicated by a block arrow and contacted the home detection plate 81, serving as the position reference, provided at the apparatus main body 51. A detection signal from the photo-interrupter 72 is transmitted to the CPU 113 and is stored as the position reference.

FIG. 5 illustrates a state in which the flag 71 waits at a predetermined waiting position corresponding to the size of the conveyed sheet S. This waiting position is set by driving the stepping motor 74 based on a value obtained by converting a necessary moving distance into a stepping angle of the stepping motor 74, making the position reference shown in FIG. 4 an origin. When the sheet size is small, the waiting position moves to the left from the position shown in FIG. 5.

FIG. 6 illustrates a state in which the supporting block 73 interrupts the photo-interrupter 72 by being rotated because the supporting block 73 has moved in a direction indicated by a block arrow and the flag 71 has contacted an edge of the sheet S while the leading edge of the sheet S has been blocked by a nip between the pair of conveying rollers 28*b* which have stopped.

The moved distance from the predetermined waiting position corresponding to the sheet size shown in FIG. 5 to the detection position shown in FIG. 6 is output based on the driven step angle of the stepping motor 74, and is transmitted via the CPU 113 to the image forming unit 12, serving as image forming means, shown in FIG. 1. The image forming unit 12 includes an optical system 109, a primary charger 10, a developing unit 11, a photosensitive drum 8, and the like.

By thus transmitting position information relating to the position of the edge of each sheet being conveyed to the image forming unit 12, it is possible to provide an appropriate image forming position for each sheet by dealing with deviation in the position of the sheet due to sudden skew, or the like.

Next, a description will be provided of the timing to detect the position of an edge of a sheet. In FIG. 2, since the leading edge of a sheet passing through a reversal operation by the fixing unit 4 and the large-diameter roller 25 after image formation on the first surface is sometimes not maintained perpendicular to the conveying direction due to skew movement, or the like, registration of the leading edge of the sheet, i.e., skew correction, is performed before the sheet joins with the conveying path 7.

More specifically, the pair of conveying rollers 28*b* await the sheet conveyed by the pair of conveying rollers 28*a*, in a stopped state. After causing the leading edge of the sheet to contact a nip portion between the pair of conveying rollers 28*b*, the pair of conveying rollers 28*a* conveys the sheet by a small amount to form a loop in the sheet. When the sheet has assumed the looped state, the pair of conveying rollers 28*a* stop rotation. During this period, the leading edge of the sheet is corrected to be parallel to the axis of the pair of rollers 28*b*.

Accordingly, when restarting the pair of conveying rollers 28*b*, the leading edge of the sheet is in a state of registration alignment. Registration correction of the leading edge of the sheet in the reconveying path is indispensable as a recent technique to improve the stability in conveyance.

The above-described sheet-edge detection operation shown in FIGS. 4, 5 and 6 is performed by utilizing the timing of stop of the sheet during registration correction of the leading edge of the sheet by forming a loop of the sheet. Since the registration correction of the leading edge of the sheet is performed irrespective of the size of the sheet, control is not complicated. In addition, since the sheet is not stopped only for detecting the edge of the sheet, the edge of the sheet can be detected without degrading the conveyance efficiency for realizing high productivity.

The sheet-position detection device 115 of this embodiment always detects the edge of a still sheet. Hence, even if the low-cost contact-type sheet-end-position detection mechanism 35 is used, the conventional problem that the detection flag vibrates and performs erroneous detection by being pushed by the sheet hardly occurs, and exact sheet-position information can be transmitted to the image forming unit 12.

Damage to the detection flag 71 by the edge of the sheet is small, and therefore it is possible to assuredly prevent degradation in accuracy of sheet-position detection that might result from wear of the detection flag 71, and breakage of the detection flag 71.

Although in the sheet-position detection device 115 of this embodiment, the sheet-end-position detection mechanism 35 is provided at an upstream portion near the pair of conveying rollers 28*b* along the conveying paths 6*a* and 6*c* during duplex image formation, the sheet-end-position detection mechanism 35 may be provided at an upstream portion near the pair of registration rollers 9 along the conveying path 7 for conveying the sheet S on the first surface of which an image is to be formed, which joins after the sheet S is reconveyed to the conveying unit UA. In this case, the position of the sheet S is detected by utilizing the fact that the pair of registration rollers 9 temporarily stop conveyance of the sheet S. By providing the sheet-end-position detection mechanism 35 along the conveying path 7, it is possible to detect the position of the sheet S at both of image forming operations on the first and second surfaces, perform feedback of position information to the image forming unit 12 starting from image formation on the first surface, and form images on predetermined positions on the first and second surfaces. The sheet-end-position detection mechanism 35 may be provided at both of an upstream portion near the pair of conveying rollers 28*b* and an upstream near the pair of registration rollers 9. The pair of registration rollers 9 operate as stop means, skew correction means, and first skew correction means.

Although the moving distance of the detection flag 71 is controlled by the step angle of the stepping motor 74, the moving distance may also be controlled by using a DC motor instead of the stepping motor 74, and measuring the driving time for the DC motor with a timer.

Although a combination of the shield plate 71*a*, serving as an actuator, and the photo-interrupter 72 has been illustrated as the sheet-end-position detection mechanism 35, a method of directly detecting the edge of the sheet and the home detection plate 81 by a light-transmitting sensor may also be adopted.

The individual components shown in outline in the drawings are all well known in the sheet-position detection device and image forming apparatus arts and their specific construction and operation are not critical to the operation of the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims.

What is claimed is:

1. An image forming apparatus comprising:

a sheet mounting unit for mounting sheets;

image forming means for forming an image on a sheet supplied from said sheet mounting unit, wherein a position of formation of the image formed by said image forming means is adjustable in a direction transverse to a direction of conveying the sheet;

stop means for temporarily stopping a sheet;

sheet-position detection means for detecting a position of the sheet while temporarily stopped by said stop means in the direction transverse to the conveying direction of the sheet; and image-formation control means for controlling a position of formation of the image in accordance with the sheet-position information from said sheet-position detection means.

2. A device according to claim 1, wherein said sheet-position detection means detects a position of an edge of the sheet parallel to the sheet conveying direction.

3. A device according to claim 2, wherein said sheet-position detection means comprises a detection flag rotatable by contacting the edge of the sheet parallel to the sheet conveying direction, and a sensor for detecting rotation of said detection flag.

4. A device according to claim 3, wherein said detection flag is attached to a moving block in the direction crossing the sheet conveying direction, and wherein the position of the sheet is calculated based on a distance moved by said moving block until said detection flag covers said sensor.

5. An image forming apparatus comprising:

a sheet mounting unit for mounting sheets;

image forming means for forming an image on a sheet supplied from said sheet mounting unit, said image forming means adjustable in a direction transverse to a conveying direction of the sheet;

skew correction means, positioned between said sheet mounting unit and said image forming means, for correcting skew of the sheet supplied from said sheet mounting unit by temporarily stopping the sheet;

sheet-position detection means for detecting a position of the temporarily stopped sheet in the direction transverse to the conveying direction of the sheet while the sheet is temporarily stopped; and image-formation control means for controlling a position of formation of the image in accordance with the sheet-position information from said sheet-position detection means.

6. A device according to claim 5, wherein said sheet-position detection means detects a position of an edge of the sheet parallel to the sheet conveying direction.

7. A device according to claim 6, wherein said sheet-position detection means comprises a detection flag rotatable by contacting the edge of the sheet parallel to the sheet conveying direction, and a sensor for detecting rotation of said detection flag.

8. A device according to claim 7, wherein said detection flag is attached to a moving block in the direction crossing the sheet conveying direction, and wherein the position of the sheet is calculated based on a distance moved by said moving block until said detection flag covers said sensor.

9. An image forming apparatus comprising:

a sheet mounting unit for mounting sheets;

image forming means for forming an image on a sheet supplied from said sheet mounting unit, said image forming means adjustable in a direction transverse to a direction of conveying the sheet;

a reversal guiding channel for guiding the sheet by turning the sheet so as to form an image on a surface opposite to a surface where the image has been formed by said image forming means;

skew correction means, provided in said reversal guiding channel, for correcting skew of the sheet subjected to reversal guiding by temporarily stopping the sheet;

sheet-position detection means for detecting a position of the sheet in the direction transverse to the conveying direction of the sheet while the sheet is temporarily stopped; and image-formation control means for controlling a position of formation of the image in accordance with the sheet-position information from said sheet-position detection means, wherein said sheet-position detection means is provided upstream of said skew correction means.

10. An apparatus according to claim 9, wherein said reversal guiding channel comprises a conveying unit in which a reversal unit, mounted between an image forming portion and said sheet mounting unit, for turning a sheet having an image formed on a surface thereof, a reversal path for conveying the sheet turned by said reversal unit to said image forming portion, and a conveying path joining with said reversal path and for conveying a sheet accommodated in said sheet mounting means to said image forming portion are disposed in a vertical direction, and wherein said reversal path of said conveying unit is bent so as to be separated from said sheet mounting means, to cause said conveying path to join at a bent portion of said reversal path.

11. An apparatus according to claim 10, further comprising detection means for detecting a sheet passing along said reversal path inside of the bent portion.

12. An apparatus according to claim 9, wherein said sheet-position detection means detects a position of an edge of the sheet parallel to the sheet conveying direction.

13. An apparatus according to claim 12, wherein said sheet-position detection means comprises a detection flag rotatable by contacting the edge of the sheet parallel to the sheet conveying direction, and a sensor for detecting rotation of said detection flag.

14. An apparatus according to claim 13, wherein said detection flag is attached to a moving block in the direction crossing the sheet conveying direction, and wherein the position of the sheet is calculated based on a distance moved by said moving block until said detection flag covers said sensor.

* * * * *

UNITED STATES PATENT AND TRADEMARK OFFICE

CERTIFICATE OF CORRECTION

PATENT NO. : 6,799,761 B2
DATED : October 5, 2004
INVENTOR(S) : Kato

It is certified that error appears in the above-identified patent and that said Letters Patent is hereby corrected as shown below:

Column 9,
Line 25, “amount” should read -- number --.

Column 11,
Line 50, “await” should read -- awaits --.

Column 12,
Line 43, “operate” should read -- operates --.

Signed and Sealed this

First Day of February, 2005

JON W. DUDAS
*Director of the United States Patent and Trademark Office*